US008342432B2

(12) United States Patent
Mitsui et al.

(10) Patent No.: US 8,342,432 B2
(45) Date of Patent: Jan. 1, 2013

(54) ELECTROSTATIC ATOMIZER AND ITS CLEANING METHOD

(75) Inventors: Michio Mitsui, Yokohama (JP); Shinji Tani, Aichi (JP); Masahito Sakakibara, Okazaki (JP); Kimio Toda, Toyota (JP); Toshio Hosoda, Yokohama (JP)

(73) Assignees: Toyota Jidosha Kabushiki Kaisha, Aichi (JP); Ransburg Industrial Finishing K.K., Kanagawa (JP)

( * ) Notice: Subject to any disclaimer, the term of this patent is extended or adjusted under 35 U.S.C. 154(b) by 508 days.

(21) Appl. No.: 11/363,490

(22) Filed: Feb. 27, 2006

(65) Prior Publication Data

US 2006/0202067 A1 Sep. 14, 2006

Related U.S. Application Data

(63) Continuation of application No. PCT/JP2004/012696, filed on Aug. 26, 2004.

(30) Foreign Application Priority Data

Aug. 27, 2003 (JP) ..... 2003-302281
Oct. 24, 2003 (JP) ..... 2003-364394

(51) Int. Cl.
*B05B 5/00* (2006.01)
*F23D 11/32* (2006.01)

(52) U.S. Cl. ..... 239/690; 239/690.1

(58) Field of Classification Search ..... 239/690, 239/690.1, 337, 340, 344, 349, 354, 361, 239/104, 106, 112, 600
See application file for complete search history.

(56) References Cited

U.S. PATENT DOCUMENTS 2,477,004 A * 7/1949 Paget ..... 418/203
3,432,104 A * 3/1969 Kaltenbach ..... 239/328
4,036,438 A * 7/1977 Soderlind et al. ..... 239/288.5
4,159,081 A * 6/1979 Demler et al. ..... 239/323
4,311,724 A * 1/1982 Scharfenberger ..... 427/8
(Continued)

FOREIGN PATENT DOCUMENTS

CN 88101597 A 10/1988
(Continued)

OTHER PUBLICATIONS

Supplementary European Search Report issued in corresponding European Patent Application No. 04772652 dated Jul. 22, 2010 (3 pages).

*Primary Examiner* — Davis Hwu
(74) *Attorney, Agent, or Firm* — Kilyk & Bowersox, P.L.L.C.

(57) ABSTRACT

An electrostatic atomizer 30 has a removably attachable canister 24. Once a paint bag 2 housed in the canister 24 exhausts, it is replaced by a new canister 24. Paint in a paint bag 2 is driven out by a mono pump 35 located in a pump segment 23 of the electrostatic atomizer 20. The mono pump 35 has a helical shaft 36 inside a paint feed tube 31. The mono pump 35 is driven by a servomotor via an insulating drive shaft 38. Paint in the paint bag 2 is drawn up when the helical shaft 36 rotates, and it is delivered to a bell cup 21 through the feed tube 31. Quantity of paint atomized by the bell cup 21 and interruption of the atomization are controlled by controlling the rotation of the mono pump 35.

17 Claims, 17 Drawing Sheets

U.S. PATENT DOCUMENTS

| | | | | | |
|---|---|---|---|---|---|
| 4,792,092 | A | * | 12/1988 | Elberson et al. | 239/3 |
| 4,955,960 | A | | 9/1990 | Behr et al. | |
| 5,080,289 | A | * | 1/1992 | Lunzer | 239/690 |
| 5,351,903 | A | * | 10/1994 | Mazakas et al. | 239/705 |
| 5,667,144 | A | * | 9/1997 | Snetting | 239/491 |
| 5,826,805 | A | | 10/1998 | Ito et al. | |
| 6,164,561 | A | | 12/2000 | Yoshida et al. | |
| 6,585,481 | B1 | * | 7/2003 | Sandkleiva | 415/112 |
| 6,799,698 | B2 | * | 10/2004 | Ono et al. | 222/55 |
| 6,820,824 | B1 | | 11/2004 | Joseph et al. | |
| 2002/0158148 | A1 | | 10/2002 | Hosoda et al. | |
| 2003/0234299 | A1 | | 12/2003 | Hosoda et al. | |

FOREIGN PATENT DOCUMENTS

| | | | |
|---|---|---|---|
| EP | 0792695 | B1 | 8/2002 |
| EP | 0967016 | B1 | 11/2004 |
| GB | 919806 | | 2/1963 |
| JP | 7-265749 | A | 10/1995 |
| JP | 10-66907 | A | 3/1998 |
| JP | 2000-237648 | A | 9/2000 |
| JP | 2002011396 | | 1/2002 |
| JP | 2003117447 | | 4/2004 |

* cited by examiner

ELECTROSTATIC ATOMIZER AND ITS CLEANING METHOD

The present application is a continuation of International Patent Application No. PCT/JP2004/012696, filed Aug. 26, 2004 (incorporated herein by reference), which in turn claims priority from Japanese Patent Application No. JP2003-302281, filed Aug. 27, 2003, and from Japanese Patent Application No. JP2003-364394, filed Oct. 24, 2003.

TECHNICAL FIELD

The present invention relates to an electrostatic atomizer and its cleaning method.

BACKGROUND ART

Japanese Patent Laid-open Publication No. JP2001-130751 discloses a typical configuration of an automatic coating system including an electrostatic atomizer. Metered feeding of paint to the electrostatic atomizer is effected by a pump, which expels the paint from an external paint source toward the electrostatic atomizer, and a valve, which is housed in a cabinet as a separate member from the paint electrostatic atomizer.

Outline of the automatic coating system is explained with reference to the publication No. JP2001-130751. An electrostatic atomizer is attached to an arm of a robot located on an automatic coating line. The electrostatic atomizer communicates with an external compressed air source and paint tanks of paints of different colors. The valve cabinet houses a number of solenoid valves. Paint in an external paint tank is supplied under pressure by a pump toward the electrostatic atomizer, and metered feeding of paint is substantially controlled by a solenoid valve in the valve cabinet.

When a work is brought to a predetermined position of the automatic coating line, solenoid valves in the valve cabinet are controlled in motion, and a paint passage for a paint of a certain color to coat the work is opened to supply the paint under pressure through the paint passage. Then, the electrostatic atomizer is activated to atomize the paint while receiving supplemental supply of the paint.

Coating robots used in automatic coating lines for vehicles, for example, are commonly used to paint some desired colors. Therefore, every time after a coating robot finishes coating of one vehicle of a certain color, it needs procedures for changing the color to paint the next vehicle of a different color.

Japanese Patent Laid-open Publications No. JP-H08-229446 and No. JP-H11-262696 propose cartridge-type electrostatic atomizers. Publication No. JP-H08-229446 proposes to detachably attach a paint tank unit, having a metered paint feeding means inside, to the electrostatic atomizer. Publication No. JP-H11-262696 proposes to use feed units for respective colors, each having a valve inside, and to removably attach them to the electrostatic atomizer.

The cartridge-type atomizer proposed by the publication No. JP-H08-229446 is explained here. The paint tank unit containing a given quantity of paint is detachably attached to the atomizer, and after completion of a coating process, it is detached to wash the internal paint passage of the atomizer. This cartridge-type electrostatic atomizer has the advantage of shortening the paint passage to be washed upon a change of color, and therefore contributes to saving the quantity of paint washed away from the paint passage.

Problems of the atomizer taught by the publication No. JP-H08-229446 are pointed out here. In this known electrostatic atomizer, a combination of a fluid-driven piston and a cylinder is shown as a metered paint feeding means provided inside the paint tank unit. The paint contained in the cartridge-type paint tank unit is sprayed out of the atomizer by extruding it with the piston in the paint tank unit. However, since combinations of fluid-driven pistons and cylinders, in general, need high mechanical accuracy, here is the problem that the manufacturing cost of the cartridge paint tank unit increases.

If plastic materials are used to form the piston and the cylinder for reduction of the manufacturing cost of the cartridge-type paint tank unit, then the plastic piston and cylinder may absorb and expand with the pain and working fluids, and may change in size. Then, the piston and the cylinder, if made with strict accuracy, will cling to each other and do not work.

In case the piston and the cylinder is made of metals, the electrostatic capacity inevitably increases. Therefore, a relatively thick insulating layer must be provided to prevent leakage of static electricity from the cartridge-type pain tank unit. Here is the problem that the outer dimension of the unit increases.

A common problem involved in systems configured to supply pains from external pain tanks and systems configured to supply paints from cartridge-type paint tank units is that, because the rising characteristics upon starting atomization and the trailing characteristics upon stopping atomization are relatively dull, useless consumption of paints occurs upon starting and stopping atomization.

The electrostatic atomizer is halter during the period from completion of coating of a vehicle (work) to the start of coating of the next work. In this halt period, an amount of the plaint remaining under pressure in the electrostatic atomizer may leak through the paint outlet under the atmospheric presser.

DISCLOSURE OF INVENTION

It is therefore an object of the invention to provide an electrostatic atomizer that can reduce the quantity of pain running to waste without contributing to actual coating of works.

A further object of the invention is to provide an electrostatic atomizer that can reduce the quantity of pain that leaks from the atomizer during the halt period of the atomizer.

A still further object of the invention is to provide an electrostatic atomizer including a detachable pain container, which can be simplified in structure of an element to be replaced (corresponding to a conventional cartridge-type paint tank).

A yet further object of the invention is to provide a color changing method for an electrostatic atomizer including a detachable canister, which can reduce the time necessary for color-changing operations including replacement of the canister and cleaning of internal passages.

According to the first aspect of the invention, one of more of those objects can be accomplished basically by an electrostatic atomizer for atomizing electrically charged pain toward a work, comprising:

a paint atomizing means supplied with paint from a paint source and atomizing the paint; and a paint sucking mechanism located inside the electrostatic atomizer to draw up the paint from the paint source and deliver it to the paint atomizing means.

According to the second aspect of the invention, one of more of those objects can be accomplished by a color-changing method for an electrostatic atomizer having at least two removably attached canisters each housing a paint container containing paint and a cleaning container containing cleaning liquid to draw up the paint from the paint container of selected one of the canisters by means of a paint sucking mechanism provided inside the electrostatic atomizer and to atomize and electrically charge the paint to coat a work, which is a cleaning method of the electrostatic atomizer for cleaning an internal paint path of the electrostatic atomizer during a process of replacing one of the canisters by using the cleaning container of the other canister.

In the electrostatic atomizer according to the invention, since the paint sucking mechanism is provided inside the electrostatic atomizer, the passage for paints between the paint sucking mechanism and the paint atomizing mechanism may be short. Therefore, ON/OFF response of atomization can be improved, and useless atomization upon ON/OFF switching of atomization can be reduced. Thus, useless consumption of paint can be reduced.

The paint sucking mechanism located in the electrostatic atomizer is preferably a pump permitting highly accurate delivery control, such as a gear pump or a mono pump. In this case, controllability of the quantity of paint atomized by the electrostatic atomizer and ON/OFF response of atomization of paint can be enhanced more. When the electrostatic atomizer halts atomization with its gear pump or mono pump being stopped, pressure in the internal pain passages and the paint bags become the atmospheric pressure approximately. Therefore, leakage of the paint from the atomizing means of the electrostatic atomizer can be reduced.

The paint source may be either an external paint tank or a paint tank unit detachably attached to the electrostatic atomizer. The detachable tank unit preferably includes a soft paint bag. The soft paint bag is convenient because it deflates as the paint in the paint bag is sucked by the paint sucking mechanism.

In case a gear pump or a mono pump is used as the paint sucking mechanism, the gear pump or the mono pump is preferably rotatable in the opposite direction upon a change of color to return a residue of paint in the internal paint path of the atomizer back to the paint source and to wash the internal paint path after being cleared of the paint. In this manner, quantity of the paint wasted without being used actually for coating works can be reduced significantly.

The electrostatic atomizer having the detachable paint tank unit preferably includes a cleaning liquid inlet port for introducing cleaning liquid from outside upon cleaning the internal paint path of the electrostatic atomizer before changing the color from one to another, and a cleaning liquid drain port for draining the cleaning liquid used. The cleaning liquid introduced into the electrostatic atomizer is preferably introduced not only into the internal paint path but also into the detachable paint tank unit, such that the cleaning liquid flows into the internal paint path of the electrostatic atomizer through the paint path of the paint tank unit and the connection port between the tank unit paint path and the electrostatic atomizer to wash that portion.

At least two canisters each containing a paint and cleaning liquid can be removably attached to the electrostatic atomizer. In this case, the time required for changing the color with the electrostatic atomizer can be reduced because, when one of the canisters whose paint is used up is replaced by new one, the cleaning liquid in the other canister can be used to clean the connection port between the canister and the internal paint path of the electrostatic atomizer as well as the internal paint path of the electrostatic atomizer.

The electrostatic atomizer according to the present invention is most typically used in connection to an arm of a coating robot. A drive source for driving the paint sucking mechanism is preferably located inside the electrostatic atomizer, but it may be located inside the robot arm. In case the drive source is located inside the robot arm, the electrostatic atomizer can be reduced in weight. In case a servomotor is used as the drive source, it can control the delivery of the paint with high accuracy. When the servomotor as the drive source is located inside the electrostatic atomizer, it is advantageous to enable assembling of the electrostatic atomizer to a conventional coating robot without the need of remodeling the conventional coating robot. The servomotor may be connected to the paint sucking mechanism either directly or via a power transmission means. When the power transmission mechanism is made of an insulating material, a certain insulation distance is assured.

When the servomotor is installed inside the electrostatic atomizer, its location is inherently closer to the paint sucking mechanism. Therefore, quick response to ON/OFF switching of atomization of the paint is assured.

In the method according to the present invention, at least two canisters each containing paint and cleaning liquid are removably attached to the electrostatic atomizer such that, upon exchanging one of the canisters, the other canister can be used to wash the internal paint path of the electrostatic atomizer during the replacement of the former canister. According to this method of the invention, since the interior of the atomizer can be washed during replacement of a canister, the time required for color change including replacement of the canister and cleaning of internal paths of the electrostatic atomizer can be reduced.

BEST MODES FOR CARRYING OUT THE INVENTION

First Embodiment

FIGS. 1 through 6

Figure 1:
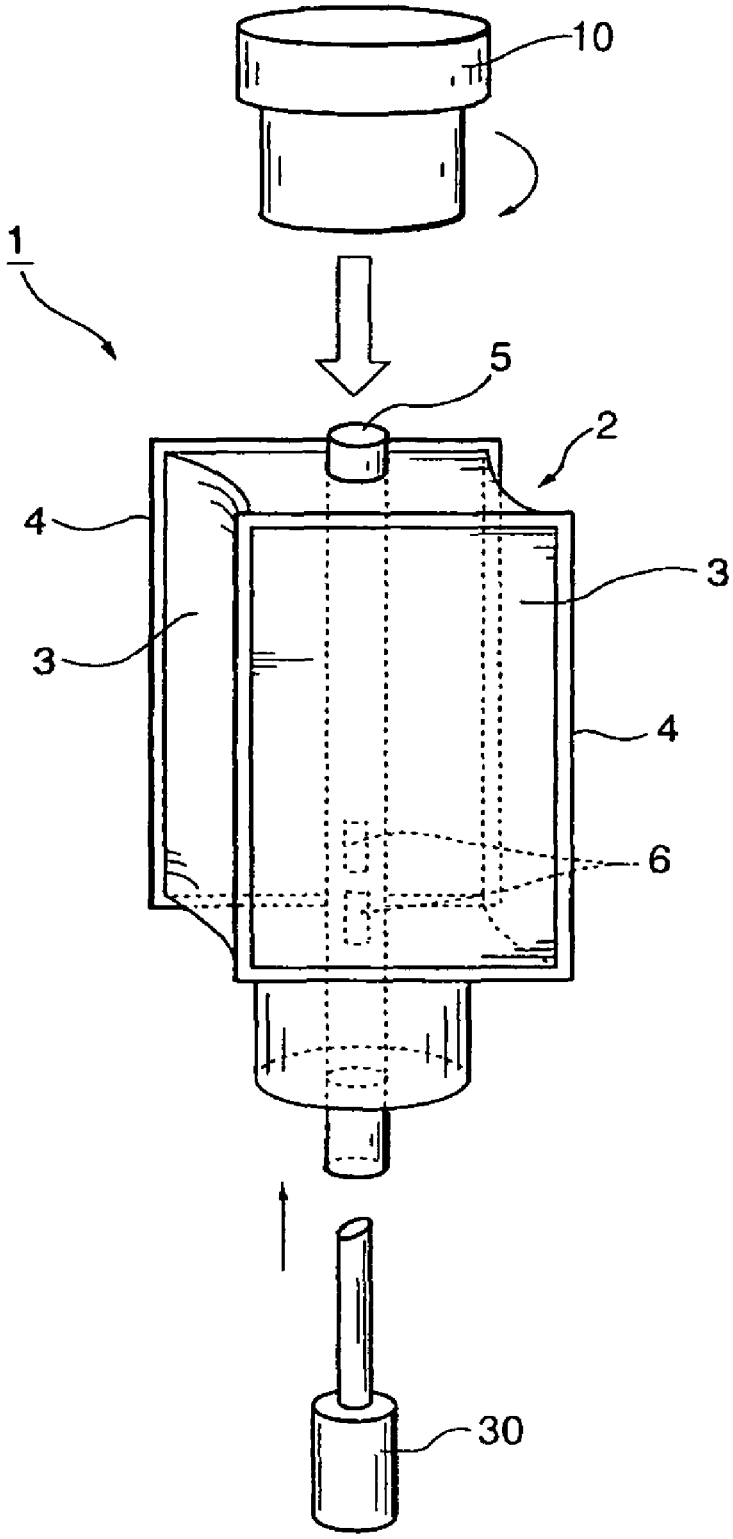
FIG. 1 is a rough perspective view of a cartridge-type paint tank used in an electrostatic atomizer according to an embodiment.

FIG. 1 shows a paint tank unit 1 of a cartridge type, which is removably attached to an electrostatic atomizer. The tank unit 1, illustrated here, includes a soft pain bag 2 as a paint container for containing a quantity of paint. The paint bag 2 has an approximately rectangular outer contour, and has a relatively hard rectangular frame 4 in each of an opposed pair of sidewalls 3. The paint bag 2 comprises two walls other than at least two end walls and the pair of sidewalls 3 having the rectangular frames 4, which bridge the pair of frames 4, 4 and are made of relatively soft material. As a result, the pair of frames 4, 4 can move closer to each other. The soft sidewalls 3 of the paint bag 2 are preferably made of a relatively soft laminate material prepared by stacking a protective film (anti-solvent protective plastic film) of polypropylene of fluorocarbon resin, which does not erode with water paints, or thinners in case of oil paints, on a metal sheet of aluminum or other metal. As another preferable form, the paint bag may be entirely made of a flexible bag alone.

The paint tank unit 1 has a hollow pipe 5 extending vertically through the paint bag 2. The hollow pipe 5 has one or more through holes 6 in lower positions of the paint bag 2. The internal space of the paint bag 2 and the internal path of the hollow pipe 5 communicate through the through holes 6. The hollow pipe 5 is a passage permitting the paint in the paint bag 2 to flow out externally and permitting a refill of paint to be introduced into the paint bag 2.

Figure 2:
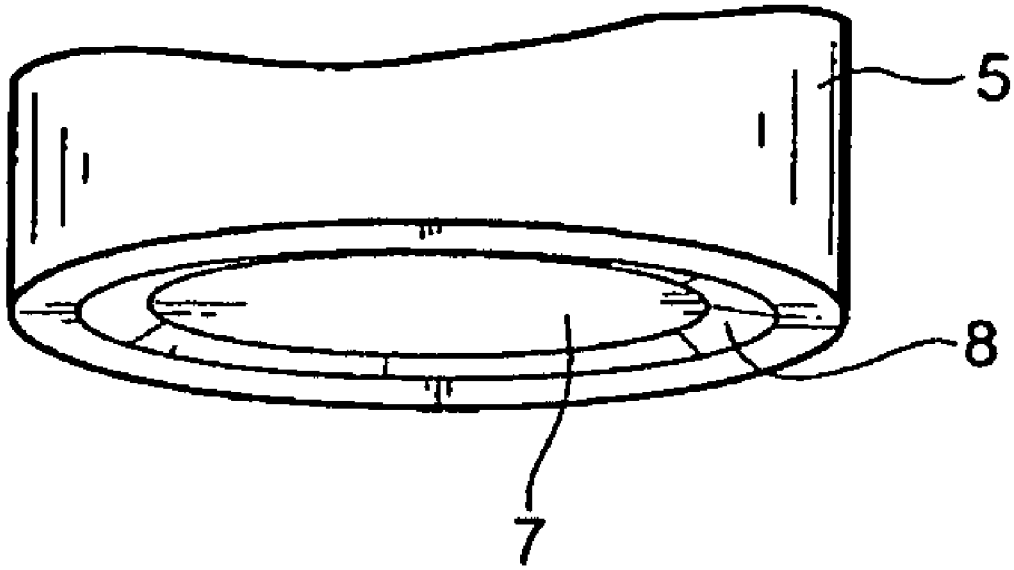
FIG. 2 is a partial perspective view that shows the lower end surface of a hollow pipe of the cartridge-type paint tank shown in FIG. 1.

In case of the type configured to introduce a refill of paint from the top end of the hollow pipe 5, the upper end of the hollow pipe 5, i.e. the end surface nearer to the paint bag 2, is preferably configured open while the lower end surface 7 is closed by a film or a sheet, for example. If the hollow pipe 5 is made of a plastic material, the closed end surface 7 may be formed integrally. The closed end surface 7 preferably has an easy-to-cut line 8 extending in the circumferential direction as shown in FIG. 2. On the other hand, in case of the type configured to introduce a refill of paint from the lower end of the hollow pipe 5, a check valve or an open/shut valve is preferably provided at the lower end of the hollow pipe 5.

More specifically, a refill of paint for refilling the paint bag 2 is introduced from the opening at the upper end or from the lower end of the hollow pipe 5. When the paint is introduced from the upper opening or the lower end of the hollow pipe 5, the paint enters into the paint bag 2, first flowing in the internal path of the hollow pipe 5 and next flowing through the through holes 6. Once the refilling of paint is completed, the opening at the upper end of the hollow pipe 5 is sealed with a cap 10. The cap 10 may be affixed by threading engagement with the upper end of the hollow pipe 5 or may be affixed by tight fitting and/or bonding to the hollow pipe 5.

Figure 3:
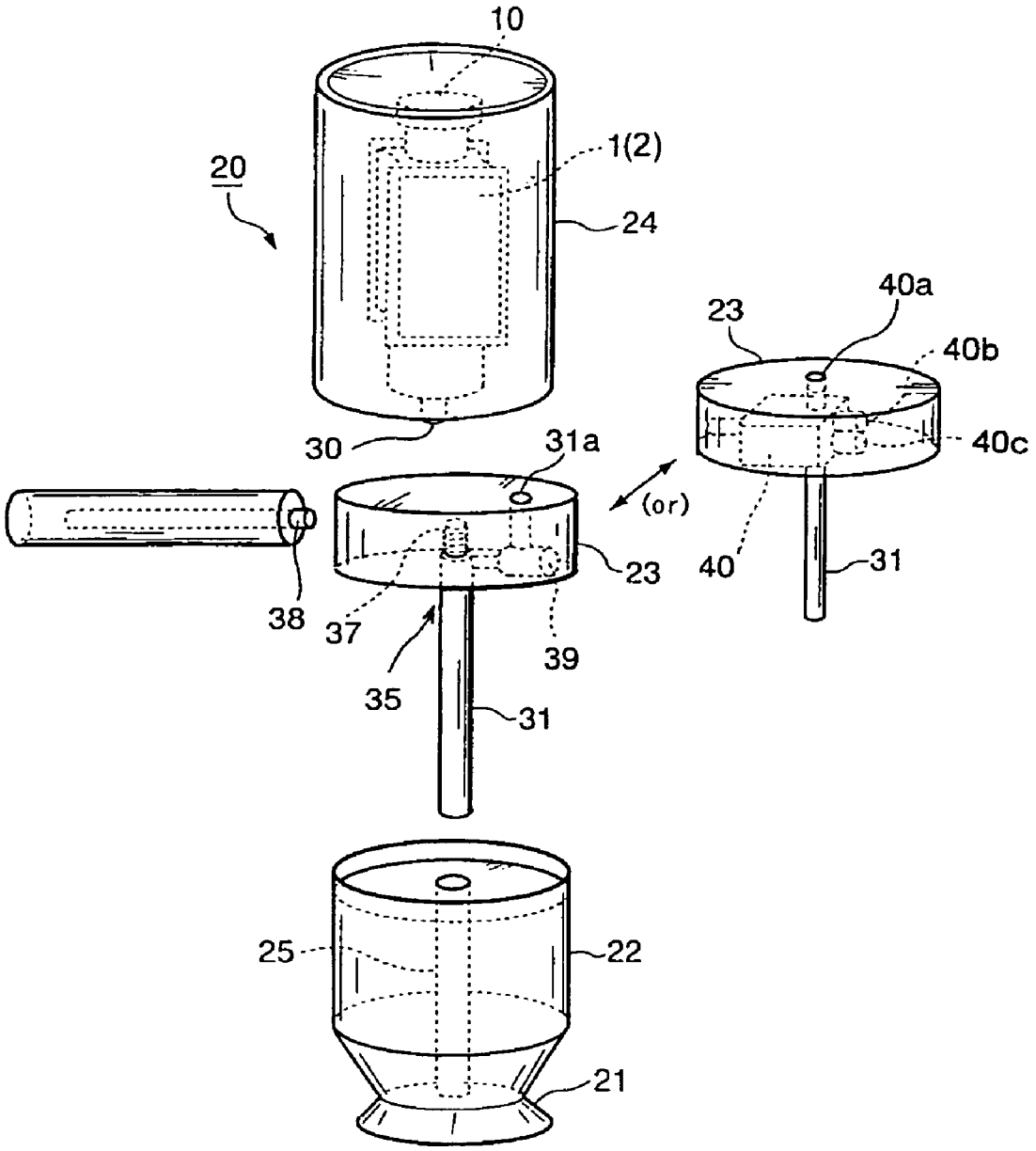
FIG. 3 is an exploded view for explaining the structure of the electrostatic atomizer according to the first embodiment.

FIG. 3 shows an electrostatic atomizer 20 to which a cartridge-type paint tank unit 1 can be attached removably. The atomizer 20 is an electrostatic atomizer, and more specifically, it is an electrostatic atomizer suitable for coating vehicle bodies or bumpers. As already known, the electrostatic atomizer 20 atomizer a paint by a bell cup 21 rotated at a high speed by, for example, an air motor located inside.

The electrostatic atomizer 20 including the paint tank unit 1 roughly comprises three segments 22 through 24 that can be separated from each other. The first segment 22 is the atomization generating segment including the bell cup 21 and the air motor (not shown). The atomization generating segment 22 has a central path 25 formed in communication with the bell cup 21. The second segment 23 is a pump segment including a paint suction pump. The third segment 24 is a canister made of, for example, a plastic material and removably accommodating a cartridge-type paint tank unit 1.

Before the paint tank unit 1 is attached to the electrostatic atomizer by, for example, threading engagement of the lower end of the hollow pipe 5, an insertion-purpose hollow needle 30 having a sharp tip for penetrating the lower end of the hollow pipe 5 is attached to the paint tank unit 1 as shown in FIG. 1. The hollow needle 30 constitutes a part of a paint feed tube explained later.

The hollow needle 30 is made of a metal or a hard plastic material. In a type where the paint is refilled from the upper end, the closed end surface 7 is cut along the easy-to-cut line 8 (FIG. 2) by stabbing the hollow needle 30 into the lower end surface 7 of the hollow pipe 5 of the paint tank unit 1. Then, the paint in the paint bag 2 can flow out externally from the hollow needle 30 through the through hole 6. In a type where the paint is refilled from the lower end, if an open/shut valve is provided at the lower end of the hollow pipe 5, the open/shut pipe is opened to permit the paint in the paint bag 2 to flow out externally.

The pump segment 23 includes a paint feed tube 31 that can be inserted into the central path 25 of the atomization generating segment 22. A paint sucking mechanism is assembled to the paint feed tube 31.

Figure 4:
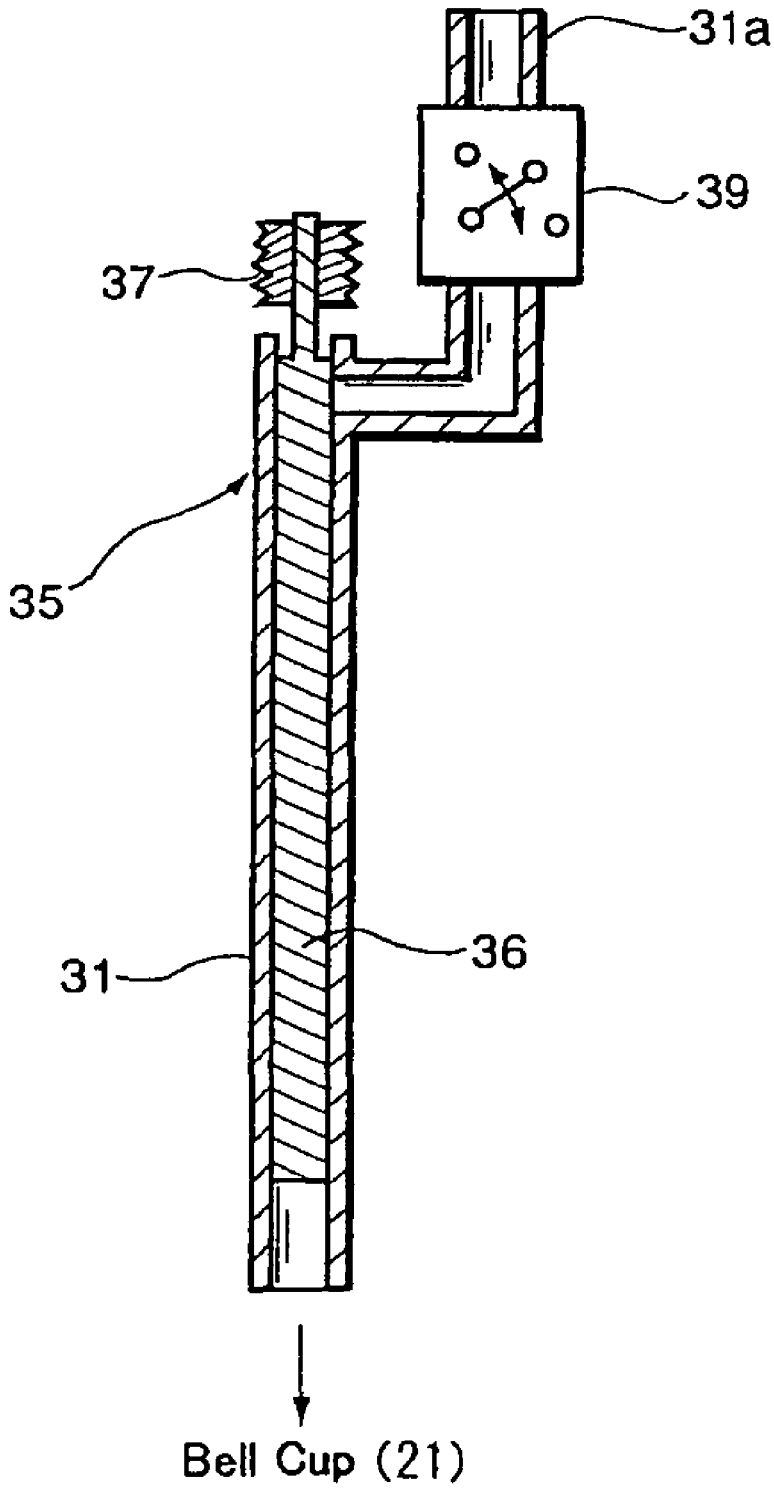
FIG. 4 is a cross-sectional view for explaining an outline of a pump segment in a version using a mono pump in the electrostatic atomizer according to the first embodiment.
Figure 5:
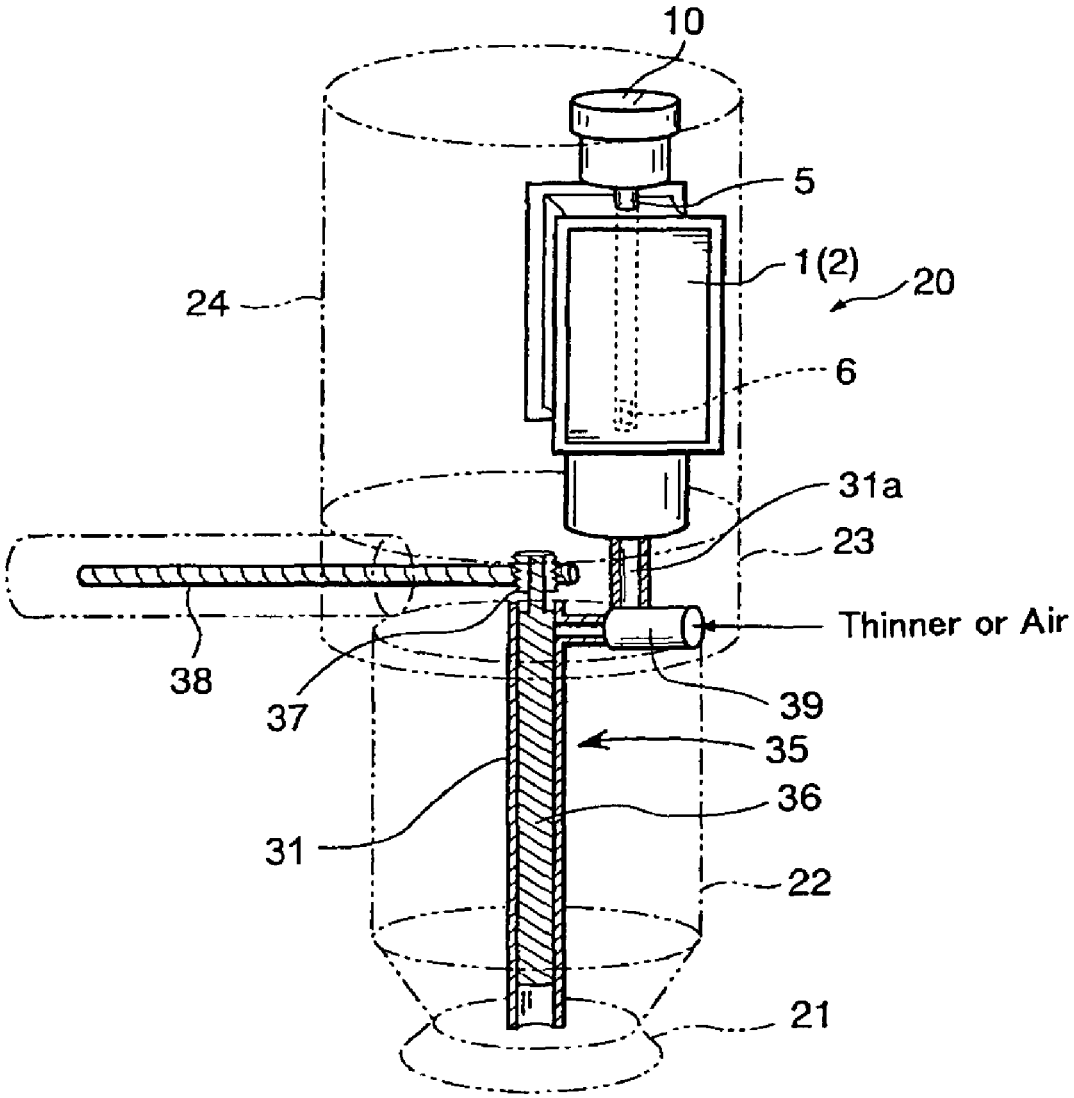
FIG. 5 is a diagram for explaining the internal structure of the electrostatic atomizer using the mono pump of FIG. 4.
Figure 6:
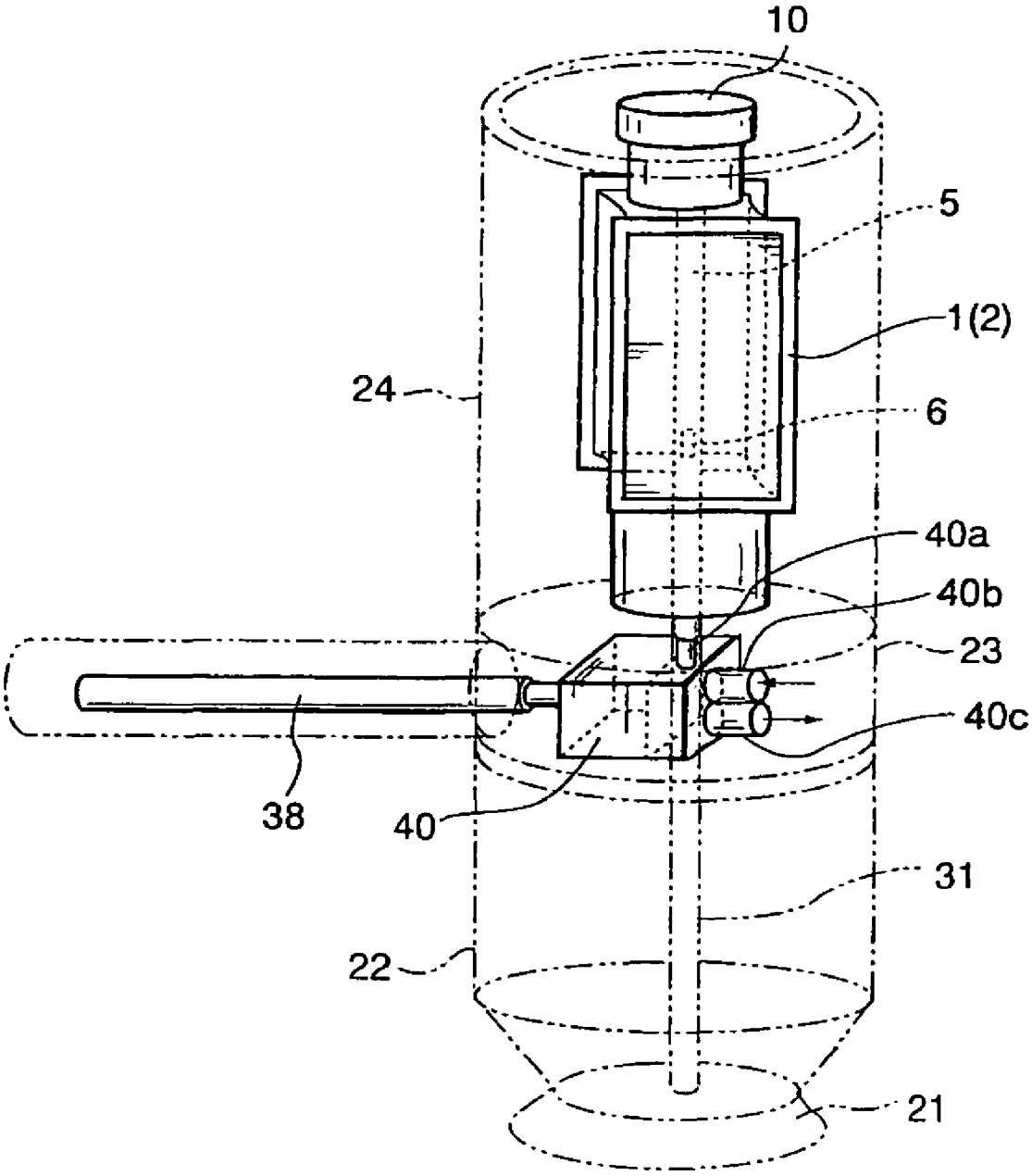
FIG. 6 is a diagram for explaining the internal structure of a version using a mono pump of the electrostatic atomizer according to the first embodiment.

FIG. 3 shows a mono pump 35 and a gear pump 40 as a pump usable as the paint sucking mechanism. With reference to FIG. 4 and FIG. 5, the mono pump 35 has a helical shaft 36 inserted into the feed tube 31. The helical shaft 36 is connected to a drive shaft 38 as a power transmission means via a gear 37, and rotated by rotations of the drive shaft 38. A wire may be used as the power transmission means instead of the drive shaft 38. However, the drive shaft 38 free from contortion and deflection is superior in response.

The drive source for rotating the drive shaft 38 may be any of air, liquid and electric drive sources. However, an explosion-proof AC servomotor, which is excellent in response and accurately controllable, is preferable. The drive source is located outside the electrostatic atomizer 20 (typically in a coating robot) or inside the electrostatic atomizer 20. In case the drive source is located inside the electrostatic atomizer 20, the drive source may be connected to the mono pump 35 either directly or via the drive shaft 38.

In case a servomotor is used as the drive source of the mono pump 35, the power transmission means (typically a drive shaft) is preferably made of an insulating material to assure electrical insulation. When the helical shaft 36 inserted into a tube constituting a part of the feed tube 31 rotates, the paint is sucked from the paint bag 2 and supplied to the bell cup 21 via the feed tube 31. FIG. 3 and FIG. 5 omit illustration of a gear provided at the tip of the drive shaft 36 and getting in threading engagement with the gear 37.

The paint feed tube 31 has an inlet port 31*a*. Once the paint tank unit 1 is attached to the canister 24, the opening at the lower end of the hollow needle 30 protruding downward from the canister 24 enters into the inlet port 31*a* of the feed tube 31, for example, and the hollow needle 30 becomes a member constituting a part of the feed tube 31.

A selector valve 39 is provided at the inlet port 31*a*. By activating the selector valve 39, it is possible to make the first configuration for sucking the paint from the paint bag 2; the second configuration for interrupting communication with the paint source and introducing air from the air source into the feed tube 31; and the third configuration for interrupting communication with the paint source (paint bag 2) and introducing cleaning liquid such as thinner into the feed tube 31. The second and third configurations are used for washing the electrostatic atomizer 20 with cleaning liquid (such as thinner) supplied from outside upon changing the color of paint.

The gear pump 40 as the second example of the paint sucking mechanism has a sucking port 40*a* projecting upward from the pump segment 23B. The paint sucking port 40*a* can engage with the lower end of the hollow pipe 5 of the canister 24 or with the hollow needle 30. The paint entering into the paint sucking port 40*a* is delivered to the central portion of the bell cup 21 under high rotation through the paint feed tube 31 extending downward from the pump segment 23B. The gear pump 40 is driven by the drive shaft 38 explained before.

The gear pump 40 has a shaft-cleaning inlet port and a shaft-cleaning outlet port, 40*b* and 40*c* (FIG. 3 and FIG. 4). Valves are provided in cleaning liquid paths communicating with the shaft-cleaning inlet port 40*b* and the shaft-cleaning outlet port 40*c*, respectively. Upon changing the color of paint, for example, cleaning liquid (such as thinner or water) is introduced from outside into the internal paint path of the electrostatic atomizer 20 to wash the inside of the gear pump 40 and the shaft. Cleaning liquid after washing the internal path of the atomizer 20 is drained externally. The waste liquid is preferably collected by washing shroud and received in a collector tank outside the coating booth. Especially when the atomizer 20 uses an electrically conductive paint (typically, water paint), after the atomizer 20 is washed, the cleaning liquid remaining inside is forcibly driven off externally with air to ensure insulation of the internal pain path of the atomizer 20 and the gear pump 40.

The mono pump 35 and the gear pump 50 can accurately control the delivery quantity of paint by control of the revolution thereof as well known in the technical field of pumps. Therefore, by detecting the revolution of the rotary shaft 38 of the mono pump 35 or gear pump 40, the delivery quantity of paint can be controlled accurately.

In case the power source for driving the mono pump 35 or gear pump 40 mounted inside is provided in the electrostatic atomizer 20, the drive shaft 38 for transmitting the power may be short. As a result, the timing of operations of the drive source and the timing of operations of the pump 35 or 40 coincide substantially. Therefore, quick response to ON/OFF switching of atomization is assured.

Once the new paint bag 2 exhausts, the paint tank unit 1 is removed from the canister 24, and a new paint tank unit 1 is attached to the canister 24. In a modified version, the canister 24 may be replaced. The paint tank unit 1 or paint bag 2 may be disposable. However, they are preferably configured reusable by refilling the removed exhausted paint bag with new paint.

To use the paint tank unit 1 repeatedly, a lower cap capable of threading engagement, for example, with the lower end of the hollow pipe 5, for example, and in case the lower cap is made of a plastic material, for example, an easy-to-cut line may be formed in its cap portion. Alternatively, the cap portion of the lower cap may be made of a film or a sheet the hollow needle 30 (FIG. 1) can break through, and the paint may be extracted by cutting the cap portion of the lower cap with the hollow needle 30.

In this manner, when the paint tank unit 1 exhausts, it can be easily recovered usable by removing it and replacing the broken lower cap with a new lower cap. The paint tank unit 1 according to the above-explained embodiment may be configured reusable as well by replacing the hollow pipe 5 having a broken portion in its lower end surface with a new hollow pipe.

It is also possible to wash the interior if the paint bag 2 in the removed paint tank unit 1 and refill it with paint. If only a short period of time as passed after the paint tank unit 1 is removed, it may be refilled with paint without washing the internal cavity thereof. However, if a paint tank unit 1 is reused repeatedly without being washed, sediments will accumulate inside the paint tank unit 1. Therefore, the paint tank unit 1 had better be washed periodically.

The hollow pipe 5 of the paint tank unit 1 has an orifice at the lower end thereof to narrow its inner diameter. In this case, even after a removed exhausted tank unit (paint bag 2) is refilled with paint, the hollow pipe 5 can retain the paint without leakage.

Second Embodiment

FIG. 7 and FIG. 8

Figure 7:
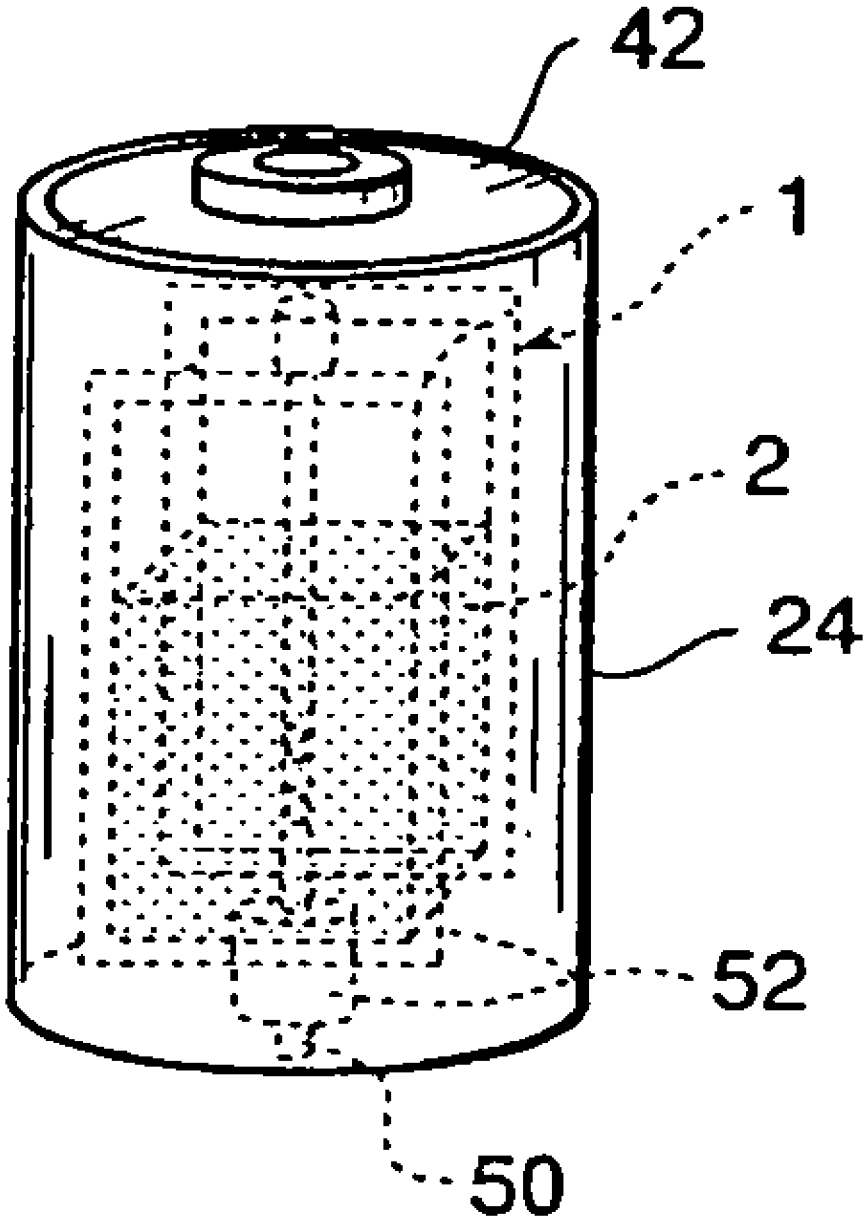
FIG. 7 is a perspective view of a canister used in an electrostatic atomizer according to the second embodiment.

When the color of paint should be changed or the paint in the paint bag 2 is used up, the above-explained first embodiment replaces the paint tank unit 1 including the paint bag 2. However, the second embodiment is configured to replace the canister 24. More specifically, as shown in FIG. 7, the canister 24 held in the paint tank unit 1 including the paint bag 2 is removably attached to the pump segment 23 of the atomizer 20 including the atomization generating segment 22 and the pump segment 23. When the color of paint should be changed or the paint bag 2 exhausts. The canister 24 is removed from the atomizer 20, and a new canister 24 is attached to the pump segment 23 of the atomizer 20.

Figure 8:
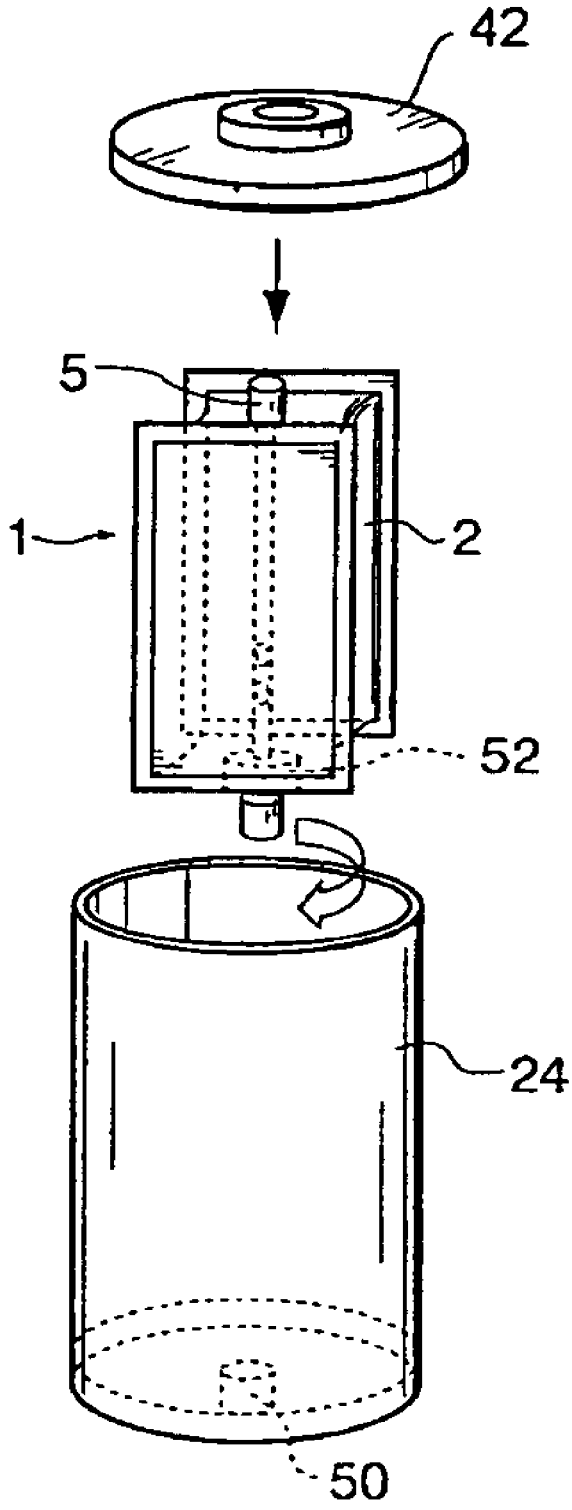
FIG. 8 is an exploded perspective view for explaining operations for exchanging a paint tank unit (paint bag having a hollow pope) in a canister.

The canister 24 includes a check valve of open/shut valve 52 in its paint outlet port 50 or at the lower end of the hollow pipe 5 of the paint tank unit 1 (FIG. 7 and FIG. 8). A refill of paint into the empty canister 24 (paint bag 2) is introduced through the paint outlet port 50 keeping the paint bag 2 housed in the canister 24.

In case the paint bag 2 deteriorates due to repetitive use, of paint makes clag in the paint bag 2, it is convenient to permit the paint tank unit 1 (paint bag 2) to be removed from the canister 24 and replaced with new one after removing a canister lid 42 of the canister 24. For example, the lower end of the hollow pipe 5 penetrating the paint bag 2 may be brought into removeable threading engagement with the paint outlet port 50 of the canister 24. In a modified version, the canister 24 may have a structure not including the paint tank unit 1. That is, the canister 24 may be configured as a hard cartridge-type paint container.

Third Embodiment

FIG. 9

Figure 9:
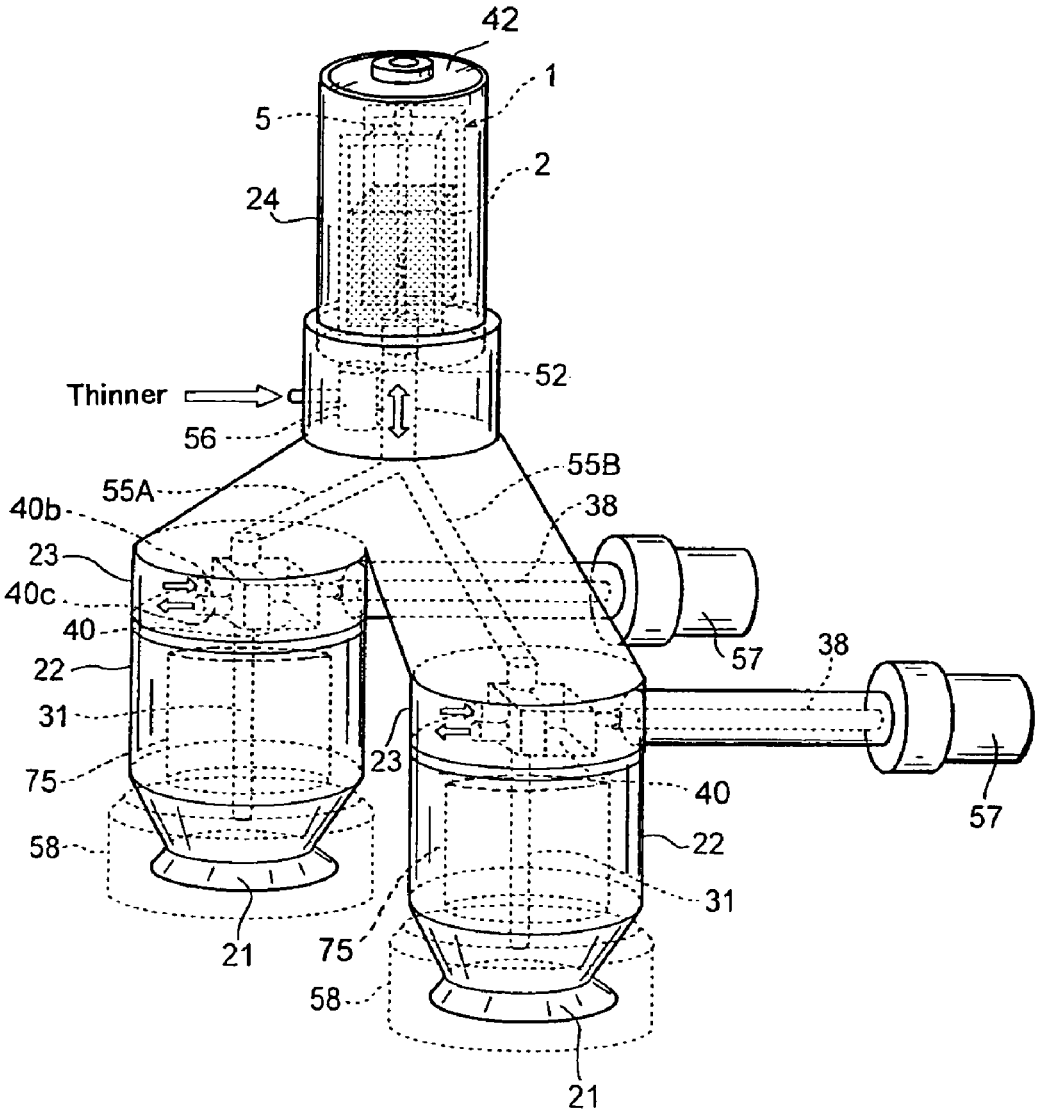
FIG. 9 is a diagram for explaining the entire structure of a double-headed atomizer according to the third embodiment.

In the first and second embodiments explained above, the atomizer has been explained as delivering the paint to a single bell cup 2 from the canister 24. However, as shown in FIG. 9, the paint may be supplied from the single canister 24 to two or more bell cups 21. The double-headed atomizer shown in FIG. 9 has two heads. Each of these two heads has its own pump segment 23 and own atomization generating segment 22. The respective pump segment 23 are supplied with paint through paint supply paths 55A, 55B that bifurcate from the paint outlet port 50 of the single canister 24. Reference numeral 56 in FIG. 9 denotes a cleaning gate valve that is opened upon a change of color to introduce a cleaning liquid such as thinner from outside into the internal paint path of the atomizer 20. Reference numeral 57 in FIG. 9 refers to a motor coupling, and 58 denotes washing shroud.

Figure 10:
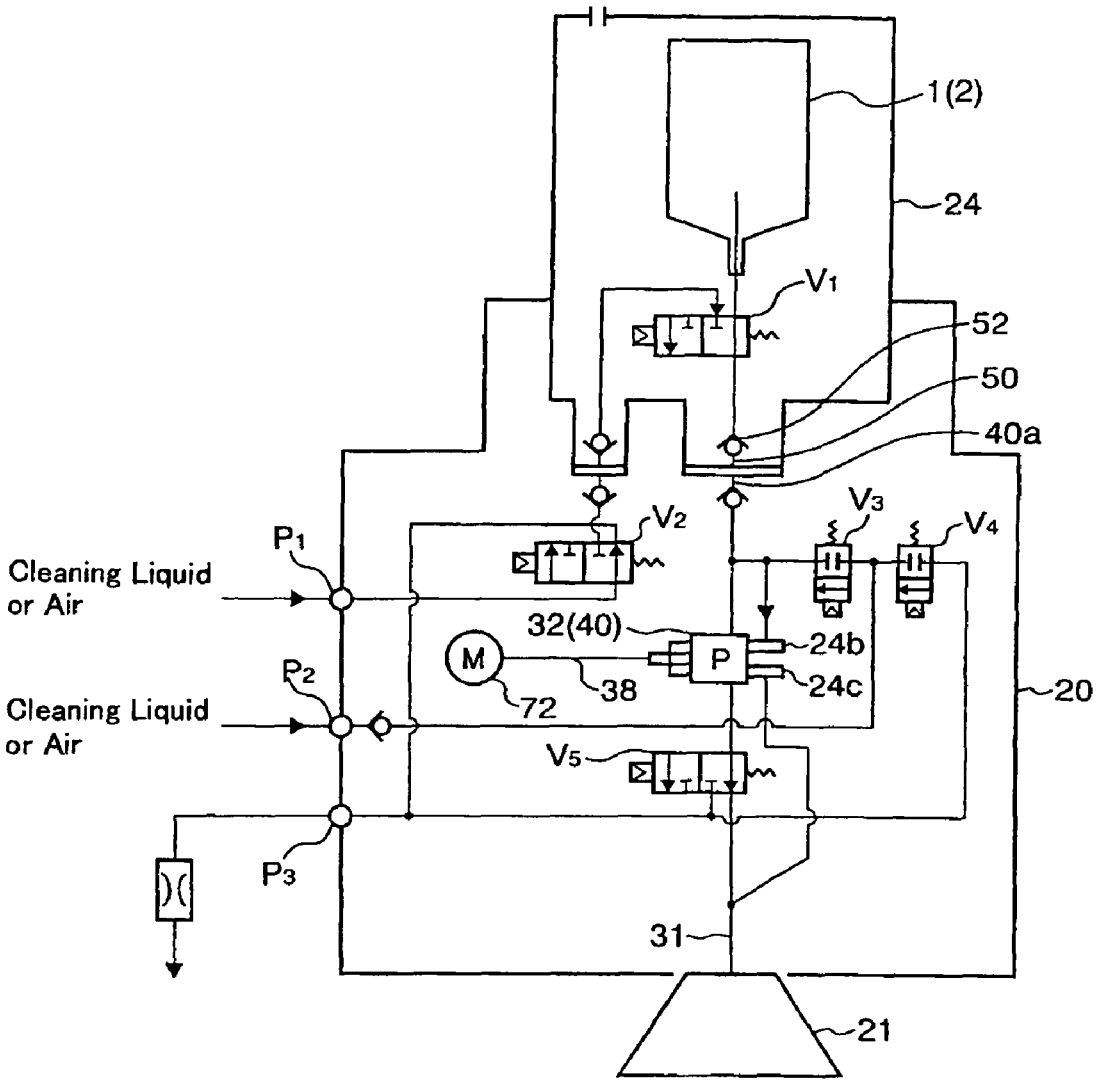
FIG. 10 is a diagram for explaining a cleaning circuit using cleaning liquid supplied from outside in relation to the first to third embodiments.
Figure 11:
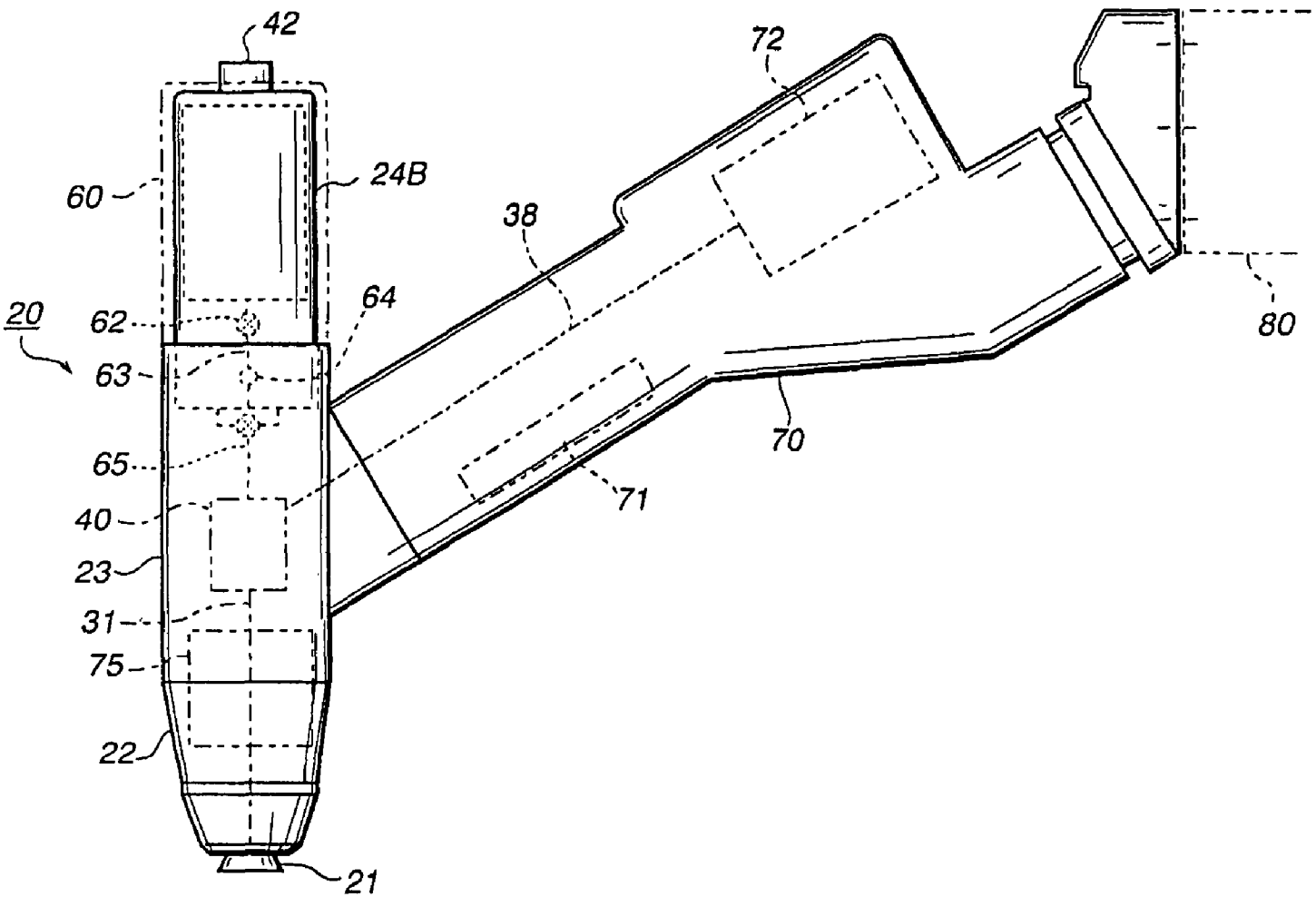
FIG. 11 is a rough side elevational view of an electrostatic atomizer according to the fourth embodiment.
Figure 12:
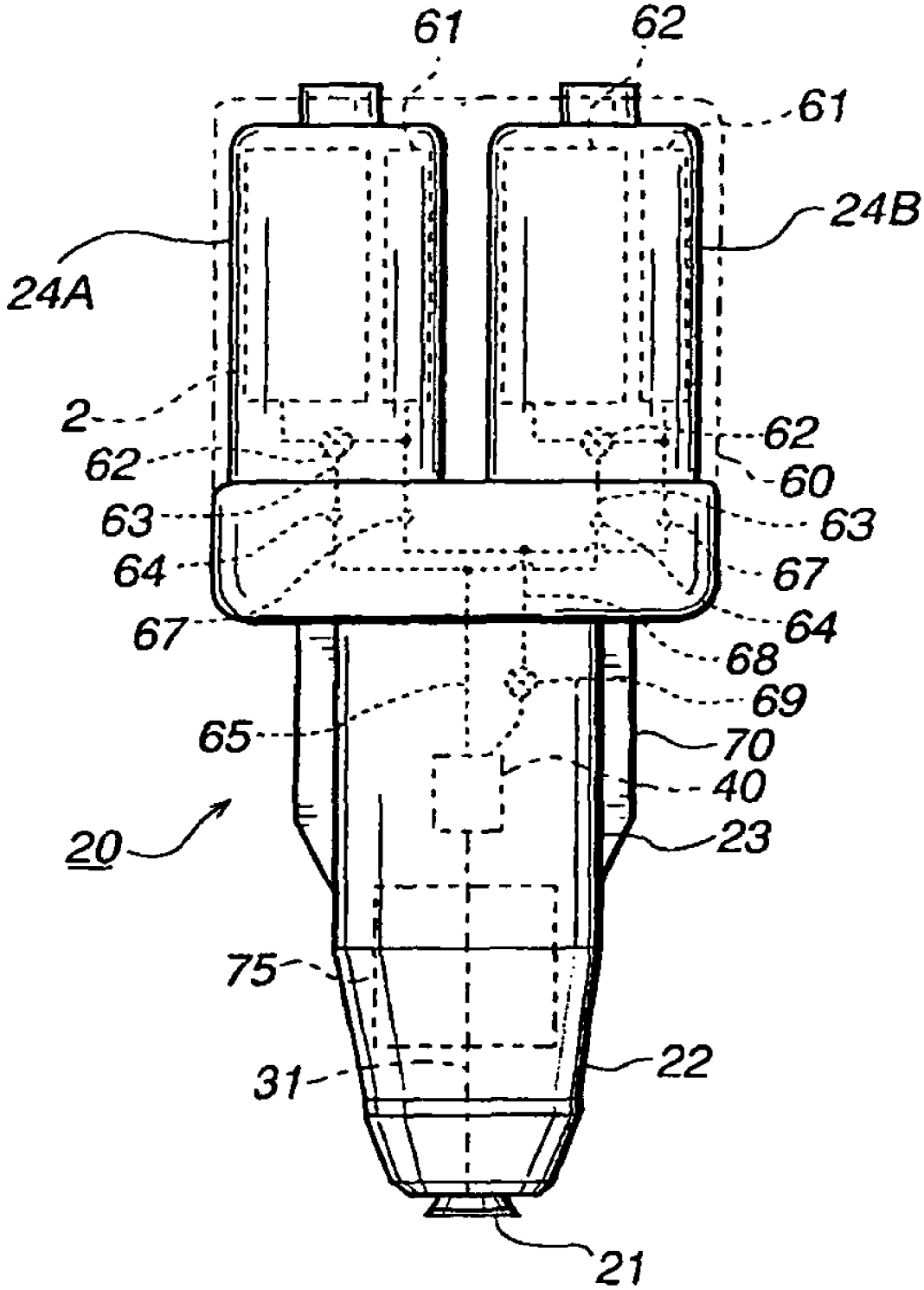
FIG. 12 is a front elevational view of the electrostatic atomizer shown in FIG. 11.
Figure 13:
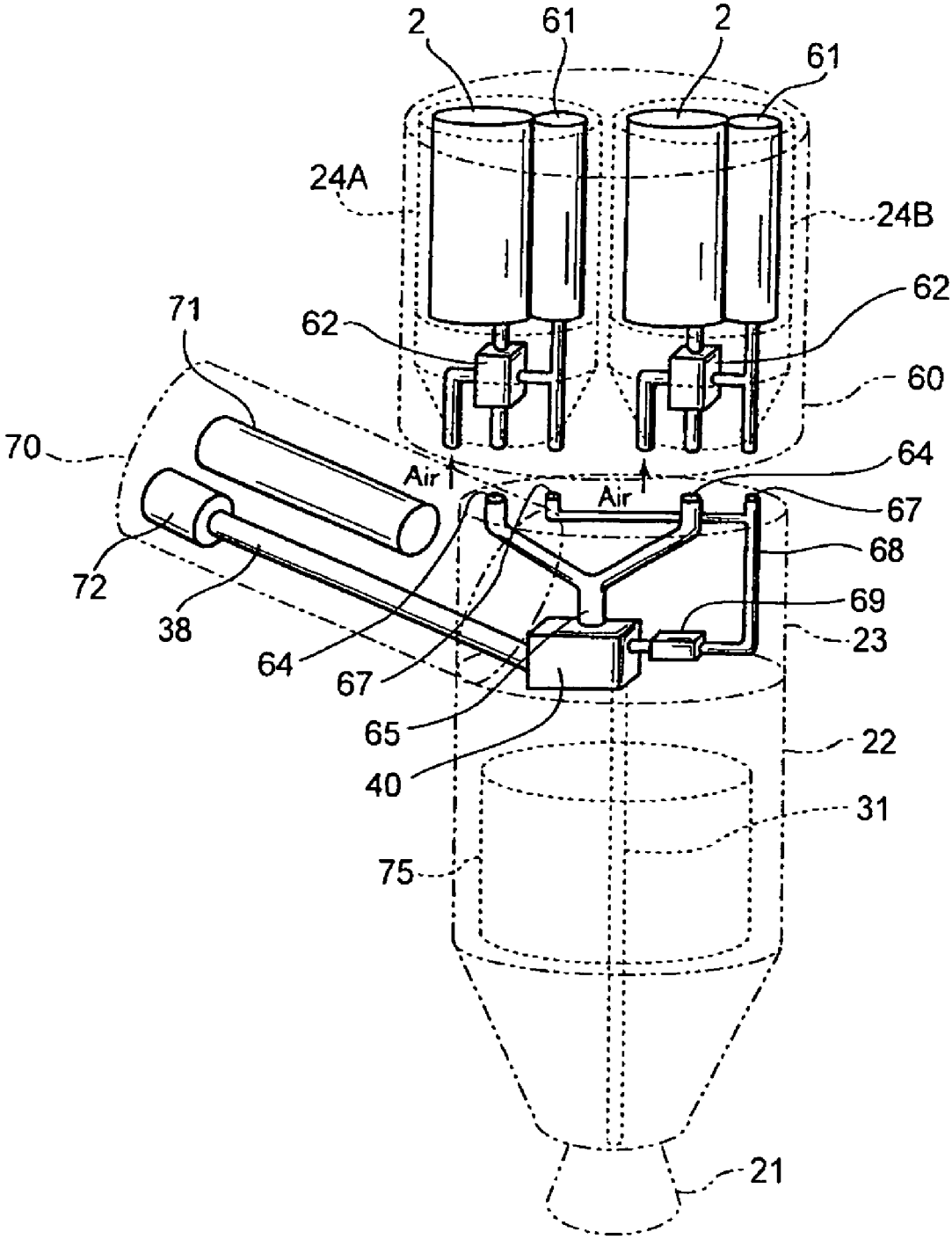
FIG. 13 is a diagram for explaining the internal structure of the electrostatic atomizer according to the fourth embodiment.

With reference to the first to third embodiments, FIG. 10 shows a cleaning circuit suitable for cleaning the connection port between the internal paint path of the atomizer 20 and the canister 24 during a change of color. V1 through V5 designate valves provided in the cleaning circuit. The electrostatic atomizer 20 has first to third three ports P1~P3 related to cleaning. Although a gear pump 4 is shown in FIG. 10, it may be replaced by a mono pump 35. Cleaning liquid (such as thinner) supplied from outside through the first cleaning liquid inlet port P1 is delivered to the canister 24 through the valve V2 and a cleaning liquid connection port P4. Then, it flows through the internal paint path of the canister 24 to wash the connection port 40*a* on the part of the electrostatic atomizer 20 and mainly the upstream portion of the internal paint path of the gear pump 40. Cleaning liquid supplied from outside through the second cleaning liquid inlet port P2 mainly washes the interior of the gear pump 40 and its downstream internal paint path 31. Waste liquid after used for the cleaning is drained externally through the cleaning liquid drain port P3. Especially when the atomizer 20 uses an electrically conductive paint (typically, water paint), after the atomizer 20 is washed, air is introduced from the ports P1 and P2 to drive off the cleaning liquid remaining inside. The valve V2 in FIG. 10 is shown as taking the position for blowing air from the port P1. Since the canister 24 is removed after the cleaning by the cleaning liquid, the air introduced from the port p1 is used to dry the cleaning paths inside the electrostatic atomizer 20.

Fourth Embodiment

FIG. 11 through FIG. 14

The first to third embodiments have been explained with reference to FIGS. 1 through 10 as attaching the canister 24 containing pain to the atomizer 20. However, it is also acceptable to attach a canister containing both paint and cleaning liquid to the atomizer 20. To the atomizer 20, a plurality of canisters 24A, 24B housed in an open-top case 60 are attached. More specifically, first and second canisters 24A, 24B can be removably attached to electrostatic atomizer 20. The first and second canisters 24A, 24B each contain a paint bag 2 containing a quantity of water or oil paint for one or two vehicles and a cleaning bag 61 containing a cleaning liquid (typically, water or thinner). The cleaning bag 61 is substantially identical to the paint bag 2 in structure, and it is made of a soft anti-chemical flexible material, such as a laminate material prepared by stacking a protective film (protective plastic film resistant to cleaning liquids) of polopropylene or fluorocarbon resin on a metal sheet of aluminum or other metal.

Each canister 24A (24B) includes an air-driven three-way selector valve 62. An outlet path 63 of the selector valve 62 is connected to a paint path 65 of the atomizer 20 via a first connection port 64 on the part of the atomizer 20. The paint path 65 of the atomizer 20 is connected to a gear pump 40 for example (which may be a mono pump 35 as well), and the paint in the paint bag 2 is supplied to the bell cup 21 through the gear pump 40 and the paint feed tube 31. By activating the three-way selector valve 62, cleaning liquid (typically, thinner) in the cleaning bag 51 is supplied to the gear pump 40 and the paint feed tube 31 to wash them. The cleaning bags 61 in the first and second canisters 24A, 24B communicate with a bypass cleaning liquid path 68 in the atomizer 20 through the second connection port 67. An air-driven path open/shut valve 69 is interposed in the bypass cleaning liquid path 68.

The atomizer 20 has a branch extension 70 extending laterally straight from near the gear pump 40. The branch extension 70 may be a robot arm alternatively. The branch extension 70 accommodates a cascade 71 for generating a high voltage, an AC servomotor 72, etc., inside. A high voltage generated in the cascade 71 is supplied to the bell cup 21 similarly to conventional devices. The output shaft of the AC servomotor 72 is connected to the gear pump 40 via a drive shaft 38 made of an insulating material. Compressed air, power and control signals to the electrostatic atomizer 20 is supplied through an air hose, signal line, etc. extending in the robot arm 80.

Once the paint bag 2 in the first canister 24A exhausts, the first canister 24A is removed from the electrostatic atomizer 20, and replaced by a new canister containing a paint bag 2 filled with paint. Similarly, once the paint bag 2 in the second canister 24B exhausts, it is replaced by a new canister containing a paint bag 2 filled with paint.

Since the first and second canisters 24A, 24B have their own cleaning bags 61 containing cleaning liquid (typically, thinner or water), the first connection port 64 especially difficult to wash can be reliably cleaned by using the cleaning liquid contained in the cleaning bag 61. More specifically, by activating the three-way selector valve 62, the electrostatic atomizer 20 can take a first mode for drawing paint out of the paint bag 2 of the first or second canister 24A, 24B and delivering it to the bell cup 21 for atomization, and a second mode for interrupting communication with the paint bag 2 and rather making communication with the cleaning bag 61 to supply the cleaning liquid (such as thinner) to the paint path 68 and the gear pump 40 to thereby clean the paint path up to the bell cup 21. In addition, the electrostatic atomizer 20 can wash its paint inlet ports 31*a*, 20*a* (FIG. 3), its internal paint path and the pump shaft of the gear pump 30, for example, by opening the air-driven path open/shut valve 69 and introducing the cleaning liquid in the cleaning bag 61 housed in the first canister 24A or second canister 24B. It is also possible for the atomizer 20 to use cleaning liquid supplied from outside through the gear pump 40 and the internal paint path of the atomizer 20 for cleaning those elements while using the cleaning liquid in the cleaning bag 61 mainly for washing the first connection port 64.

Before taking the second or third mode for changing the color of paint, the gear pump 40 may be rotated reversely to retrieve a residue of paint in the downstream side of the pump 40 back into the paint bag 2. In this manner, quantity of paint discarded in the color-changing process can be reduced.

Figure 14:
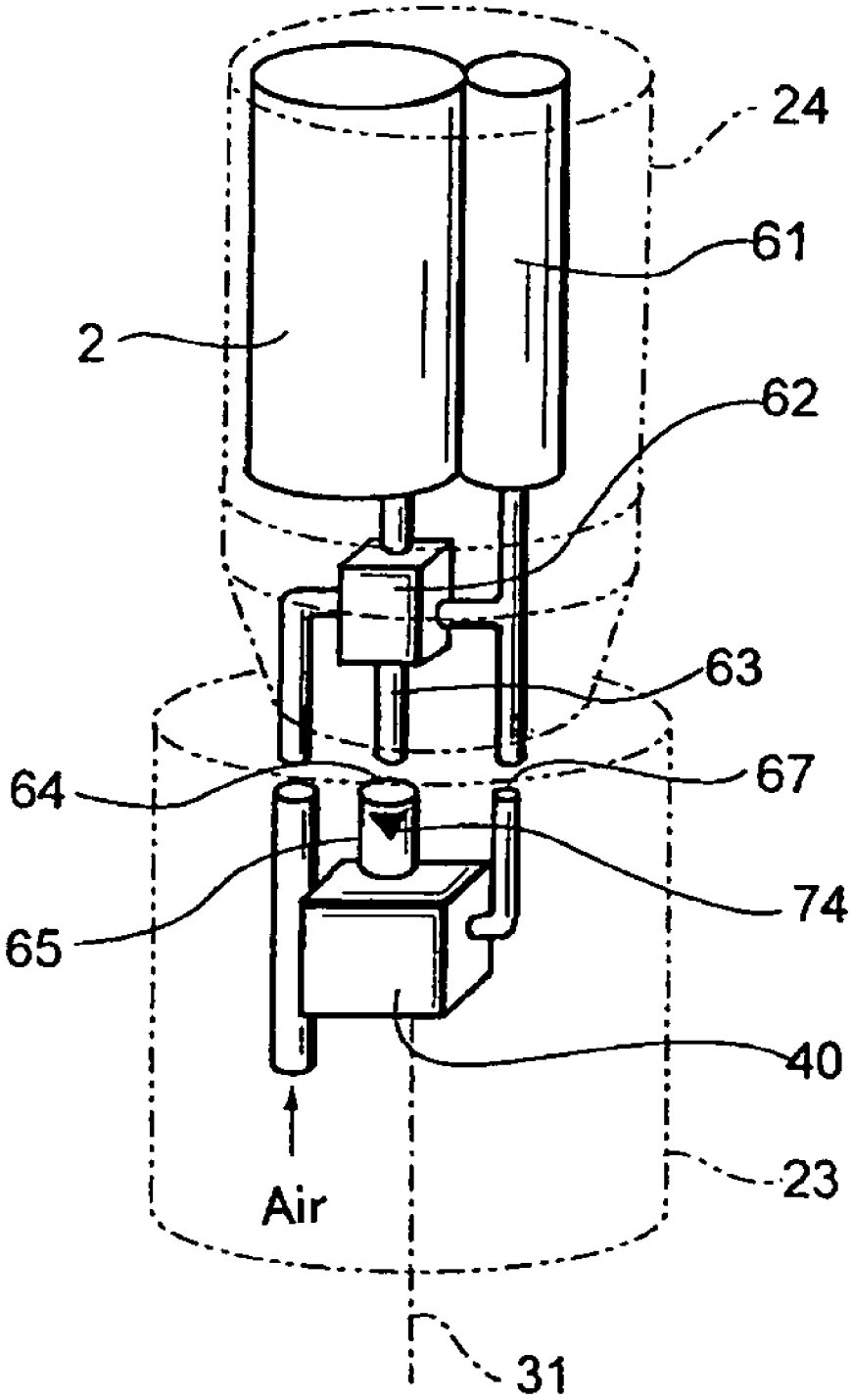
FIG. 14 is a diagram for explaining the substantial part of the internal structure of a modification of the electrostatic atomizer according to the fourth embodiment.
Figure 15:
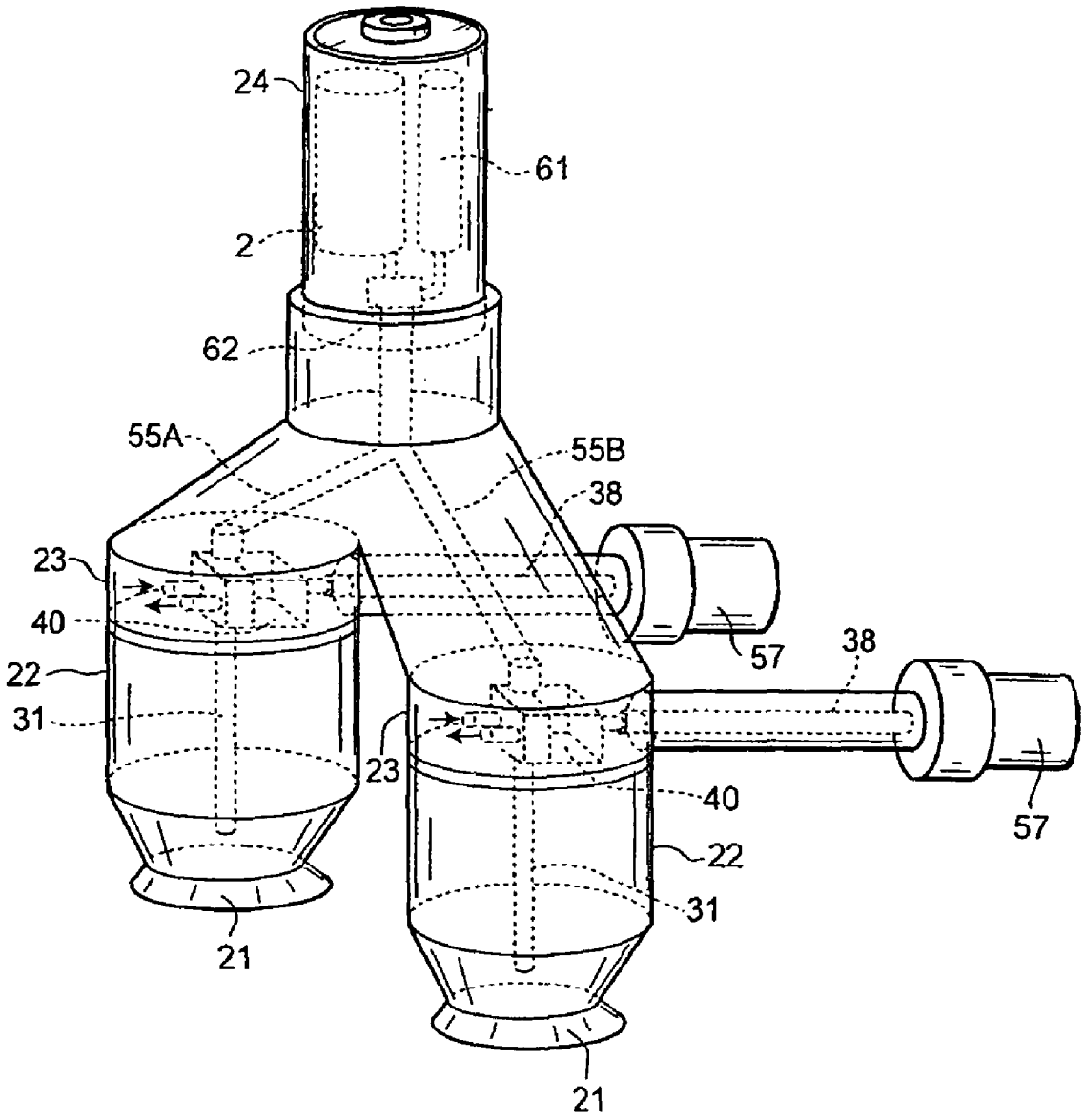
FIG. 15 is a diagram for explaining the internal structure of a double-headed electrostatic atomizer as a modification of the electrostatic atomizer according to the fourth embodiment.

As a modification, a single canister 40 containing a paint bag 2 and a cleaning bag 61 may be removably attached to the atomizer 20 as shown in FIG. 14. Further, as shown in FIG. 14, a check valve 74 may be interposed between the three-way selector valve 62 and the gear pump 40 to permit fluidal flow from the canister 40 to the gear pump 40 while prohibiting fluidal flow in the opposite direction. Removably attaching one or more canisters 24 containing both cleaning liquid and paint is applicable to the double-headed atomizer having more than one bell cups 21, which has been explained with reference to FIG. 9 (see FIG. 15). To wash the gear pump 40, cleaning liquid supplied from outside other than the cleaning bag 61 may be used.

Figure 16:
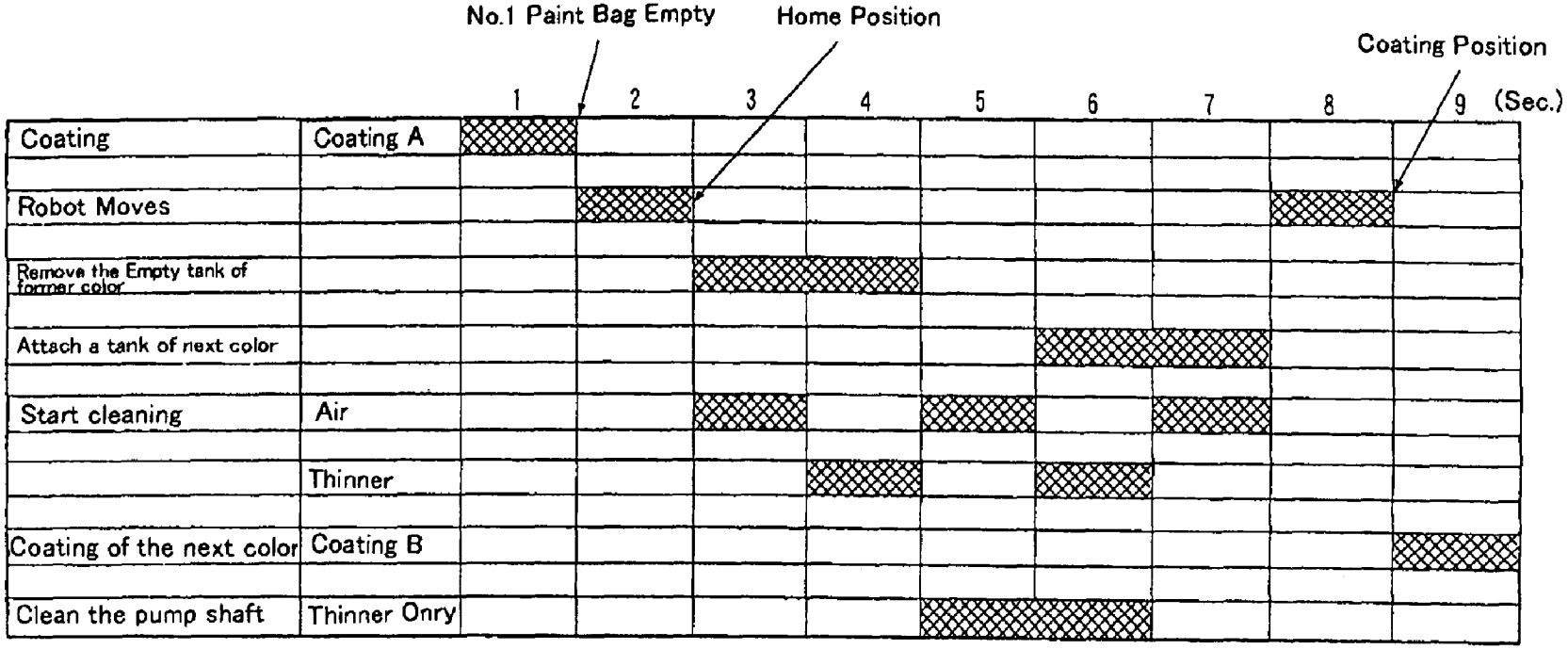
FIG. 16 is a color-changing process chart for an atomizer equipped with two canisters.

Explained below is a preferred embodiment for cleaning the atomizer 20 using cleaning bags 61 housed in two removable canisters 24A, 24B respectively. When one of the canisters, 24A (or 24B), is replaced for changing the color, the following cleaning method can reduce the time required for the change of color by using the other canister, 24B (or 24A) to clean the atomizer 20. FIG. 16 shows a color-changing process. Reference numeral 75 used in FIG. 11 and others denotes an air motor that rotates the bell cup 21 like conventional systems.

In FIG. 16, one cell corresponds to one second. For example, let the first canister 24A be replaced now. When coating by paint A in the first paint bag 2A housed in the first canister 24A is completed, and the first paint bag 2A exhausts, the robot arm 1 returns to its home position, and removal of the first canister is begun there. In synchronism with the removal of the first canister 24A, the internal paint path of the atomizer 20 and the gear pump 40 are washed by using the cleaning liquid (such as thinner) in the cleaning bag 61 housed in the second canister as well as air. In this cleaning process, a new first canister 24A containing paint B of the next color is attached to the atomizer 20. After completion of attachment of the new first canister 24A containing the paint B of the next color and cleaning of the atomizer 20, the robot arm 1 moves to the coating position and executes coating by the paint B. As such, since the atomizer 20 can be washed in the period of time for replacement of canisters, the time for changing the color can be reduced significantly.

In the fourth embodiment shown in FIGS. 11 through 15, the canister 24 containing the paint bag 2 and the cleaning bag 61 is replaced. Instead, the paint bag 2 and the cleaning bag 61 may be configured removably attachable directly to the electrostatic atomizer 20 such that they can be replaced individually when they exhaust. Although the paint bag 2 and the cleaning bag 61 have been explained as being relatively soft containers, relatively hard containers may be used instead. Furthermore, the first to fourth embodiments have been explained as employing bell-type electrostatic atomizers, but these embodiments are not limited so. The invention is applicable to coating guns not having bell heads and configured to atomize paint with aid of air or hydraulic pressure.

In the first to fourth embodiments, the pressure around the paint tank (typically a soft paint bag 2) housed in the canister 24 is held in the atmospheric pressure (by, for example, making minute pores in the canister lid 42 shown in FIG. 9) such that the upstream portion of the pump segment 23 is maintained in the atmospheric pressure. Therefore, the paint can be delivered from the electrostatic atomizer relying solely upon operations of the pump segment 23. Moreover, since the mono pump 35 or gear pump 40 can control the delivery amount with high accuracy, it is possible to control the delivery amount of paint from the electrostatic atomizer 20 with high accuracy. Furthermore, since the mono pump 35 or gear pump 40 is high in sealing effect, leakage of paint from the electrostatic atomizer 20 can be prevented during the half period of the pump 30 (or 40).

In case a servomotor is used as the drive source of the pump segment 23, excellent response of the servomotor contributes to enhancement of the rising and trailing characteristics of the delivery quantity of paint upon ON/OFF operations. In addition, since the pump segment 23 is located inside the electrostatic atomizer 20 and the length of the paint feed tube 31 downstream the pump segment 23 may be short, the rising and training characteristics of the delivery quantity of paint is improved even more.

Since the paint in the paint bag 2 is sprayed by using the pump segment 23 located inside the electrostatic atomizer 20, the atomizer 20 needs no paint delivery drive mechanism such as a cartridge-type paint tank that was required in conventional techniques. Therefore, the paint tank unit 1 can be simplified in construction, and can be made more inexpensive than conventional cartridge-type paint tanks.

Fifth Embodiment

FIG. 17

Figure 17:
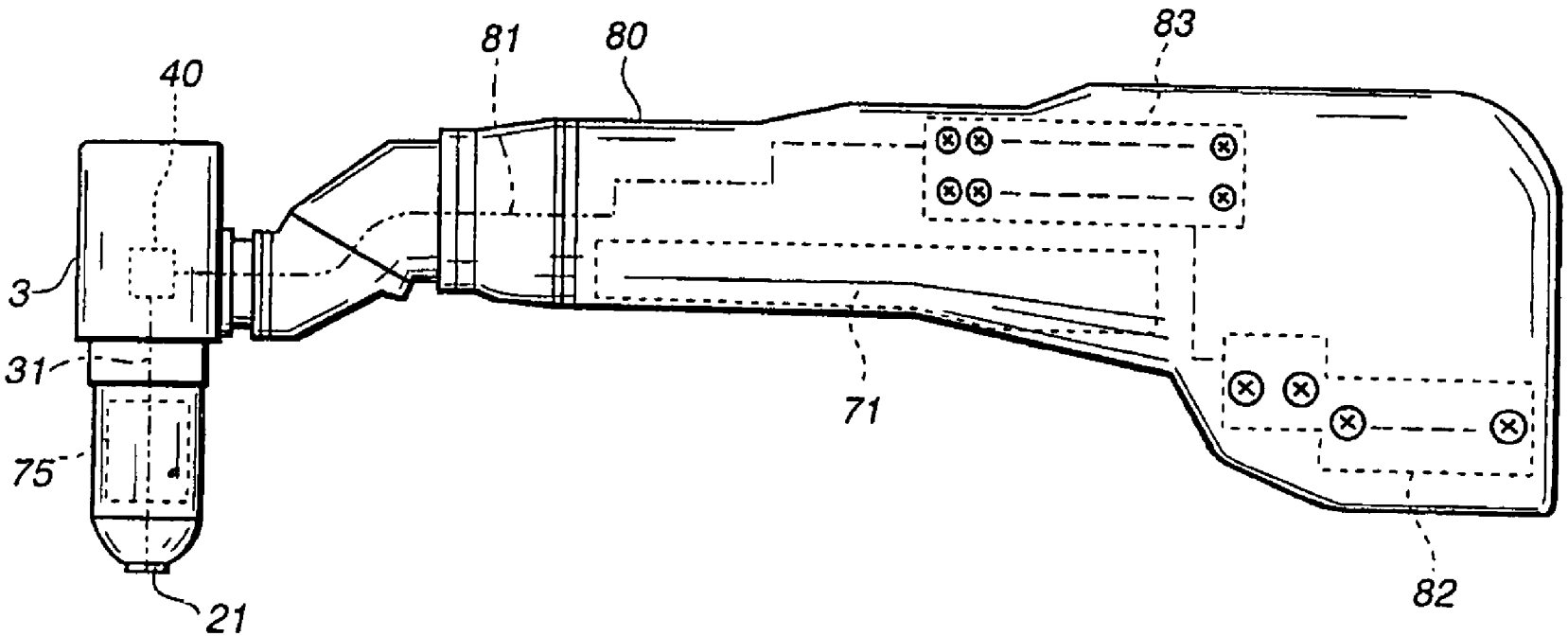
FIG. 17 is a side elevational view of an electrostatic atomizer according to the fifth embodiment, which is supplied with paint from an external paint source.

In the first to fourth embodiments explained before with reference to FIG. 1 through FIG. 5, the electrostatic atomizer 20 is supplied with paint from the detachable tank unit 1 or canister 24. Instead, the electrostatic atomizer 20 may be supplied with paint from an external paint tank (FIG. 17). With reference to FIG. 17, the electrostatic atomizer 20 having the pump segment 23 is supplied with paint from an external paint tank (not shown) through a paint pipe 81 provided inside the coating robot arm 80. More specifically, a coating robot includes solenoid valves 82 and color-changing valves 83, and the atomizer 20 is supplied with paint and compressed air through the robot arm 80.

Even in the electrostatic atomizer 20 supplied with pain from the external paint tank according to the fifth embodiment, the atomized paint is controlled by the pump segment 23 inside the atomizer 20. That is, the paint supplied from the external paint tank is drawn up by the pump segment 23 in the electrostatic atomizer 20, and then dispensed to the bell cup 21 through the paint feed tube 31. Even in the electrostatic atomizer 20 according to the fifth embodiment, The drive source for the pump segment 23 may be located either inside the electrostatic atomizer 20 or in the robot arm 80.

Also in the electrostatic atomizer 20 according to the fifth embodiment, the downstream side (exit side) of the paint path of the pump segment 23 located inside is short. Therefore, the rising and trailing characteristics of the delivery quantity of paint supplied to the bell cup 21 are enhanced. Additionally, when a servomotor is used as the drive source of the pump 23, excellent response of the servomotor significantly enhances the rising and trailing characteristics of the delivery quantity of paint upon ON/OFF operations.

Also in the electrostatic atomizer 20 according to the fifth embodiment, the pump segment 23 may be rotated reversely before a color-changing operation after completion of the preceding coating operation to return the residual paint inside the electrostatic atomizer 20 back to the paint source. In this manner, quantity of paint remaining in the electrostatic atomizer and otherwise discarded in the color-changing process can be reduced.

Heretofore, some embodiments of the invention have been explained. The invention, however, is not limited to these embodiments but contemplates the following modifications, for example.

(1) Although the embodiments have explained as using bell-type electrostatic atomizers, the invention is applicable to gun-type electrostatic atomizers as well, which are configured to atomize paint with the aid of air or hydraulic pressure.

(2) Before starting coating by using a new canister 24, pressurizing air may be supplied to the canister 24 for the purpose of initial supply of paint. This will results in increasing the internal pressure of the canister 23, then compressing the paint bag 2, and extruding a quantity of paint to the pump segment 23. Concerning the initial supply of paint to the pump segment 23, a pair of plates sandwiching the paint bag 2 may be used as a means for applying an external force to the paint bag 2 instead of increasing the internal pressure of the canister 24, and the pair of plates may be moved to reduce their distance.

(3) Before replacing the paint tank unit 1 or canister 24 containing the paint bag 2 after completion of the preceding coating, the mono pump or gear pump is preferably rotated reversely to return the residue of paint in the atomizer 20. In this manner, quantity of paint remaining in the atomizer 20 and discarded after a coating process can be reduced. This is especially effective when the interior of the atomizer is washed with cleaning thinner upon changing the color of paint.

(4) In case a mono pump 35 is used as the pump segment 23, the outlet port 50 of the canister may directly couple with the inlet port 31*a* of the feed tube 31.

(5) In case a gear pump 40 is used as the pump segment 23; the outlet port 50 of the canister may directly couple with the paint suction port 40*a* of the gear pump 40.

(6) Instead of the soft paint bag 2, a hard paint container having a port communicating with atmospheric air may be used. Such a hard paint container preferably has an open/shut valve in the atmospheric-air communicating port. The open/shut valve is opened before and after the hard paint container is attached to the electrostatic atomizer 20.

(7) The paint filling the paint bag 2 is not limited to a special kind of paint. It may be either an oil paint or a conductive paint (typically, water paint.)

The invention claimed is:

1. An electrostatic atomizer having a detachably sealed soft paint bag that is flexibly depressible as quantity of paint therein decreases for atomizing electrically charged paint from the soft paint bag toward a work, comprising:

a paint atomizing means supplied with oil or water paint from the soft paint bag through a paint feed tube and atomizing the oil or water paint;

a paint sucking mechanism located inside the electrostatic atomizer to draw up the oil or water paint from the soft paint bag and deliver it to the paint atomizing means, wherein the paint sucking mechanism comprises a pump driven by a rotating drive shaft; and a drive source located inside the electrostatic atomizer for rotating the rotating drive shaft; and wherein the oil or water paint atomized by the paint atomizing means is controlled by controlling revolution of the rotating drive shaft, and wherein the electrostatic atomizer is connectible to an arm of a coating robot.

2. The electrostatic atomizer according to claim 1 wherein the drive source comprises a servomotor and the rotating drive shaft is made of an insulating material.

3. The electrostatic atomizer according to claim 2 wherein the servomotor is rotated reversely upon a change of color of the electrostatic atomizer to return a residue of paint in the downstream portion relative to the paint sucking mechanism back to the paint source.

4. The electrostatic atomizer of claim 1, further comprising a paint feed tube wherein said paint sucking mechanism is assembled to said paint feed tube.

5. The electrostatic atomizer of claim 1, wherein said paint sucking mechanism includes a helical shaft.

6. The electrostatic atomizer of claim 1, wherein the sealed soft paint bag, the paint atomizing means, and the paint sucking mechanism are detachably connected together as segments to form a unitary atomizer unit.

7. An electrostatic atomizer supplied with paint from a paint source and atomizing electrically charged paint toward a work, comprising:

a sealed soft paint bag as an oil or water paint source removably attachable to the electrostatic atomizer;

a paint atomizing means supplied with oil or water paint from the soft paint bag through a paint feed tube and atomizing the oil or water paint;

a paint sucking mechanism located inside the electrostatic atomizer to draw up the oil or water paint from the soft paint bag and deliver it to the paint atomizing means, wherein the paint sucking mechanism comprises a pump driven by a rotating drive shaft; and a drive source located inside the electrostatic atomizer for rotating the rotating drive shaft; and wherein the oil or water paint atomized by the paint atomizing means is controlled by controlling revolution of the rotating drive shaft, and wherein the electrostatic atomizer is connectible to an arm of a coating robot.

8. The electrostatic atomizer according to claim 7 wherein the paint sucking mechanism comprises a mono pump.

9. The electrostatic atomizer according to claim 7 wherein the paint sucking mechanism comprises a gear pump.

10. The electrostatic atomizer of claim 7, further comprising a paint feed tube wherein said paint sucking mechanism is assembled to said paint feed tube.

11. The electrostatic atomizer of claim 7, wherein said paint sucking mechanism includes a helical shaft.

12. An electrostatic atomizer supplied with paint from a sealed soft paint bag and atomizing electrically charged paint toward a work, comprising:

a canister containing said soft paint bag and removably attachable to the electrostatic atomizer;

a paint atomizing means supplied with oil or water paint through a paint feed tube from the soft paint bag contained in the canister and atomizing the oil or water paint;

a paint sucking mechanism located inside the electrostatic atomizer to draw up the oil or water paint from the soft paint bag and drive out the oil or water paint to the paint atomizing means, wherein the paint sucking mechanism comprises a pump driven by a rotating drive shaft; and a drive source located inside the electrostatic atomizer for rotating the rotating drive shaft; and wherein the oil or water paint atomized by the paint atomizing means is controlled by controlling revolution of the rotating drive shaft, and wherein the electrostatic atomizer is connectible to an arm of a coating robot.

13. The electrostatic atomizer according to claim 12 further comprising:

a cleaning liquid inlet port provided in the electrostatic atomizer to receive cleaning liquid supplied from outside; and a cleaning connection port provided in the electrostatic atomizer in the way to the canister to supply the canister with cleaning liquid entering into the electrostatic atomizer from the cleaning liquid inlet port, wherein the cleaning liquid entering into the canister through the cleaning connection port flows into an internal paint path of the electrostatic atomizer through a paint path for supplying paint to the electrostatic atomizer from the canister, and thereby cleaning a paint connection port between the canister and the electrostatic atomizer.

14. The electrostatic atomizer according to claim 12 wherein the canister comprises a paint container containing paint, and a cleaning container containing cleaning liquid for use to clean the internal paint path of the electrostatic atomizer.

15. The electrostatic atomizer according to claim 14 wherein at least two said canisters are removably attached to the electrostatic atomizer.

16. The electrostatic atomizer of claim 12, further comprising a paint feed tube wherein said paint sucking mechanism is assembled to said paint feed tube.

17. The electrostatic atomizer of claim 12, wherein said paint sucking mechanism includes a helical shaft.

* * * * *